US006126705A

United States Patent [19]

Pryor et al.

[11] Patent Number: 6,126,705

[45] Date of Patent: Oct. 3, 2000

[54] PROCESS FOR TREATING COAL TAILINGS

[75] Inventors: Murray Howard Pryor, Glebe; Jeremy James Lees, Birchgrove, both of Australia

[73] Assignee: Ilecard Pty Ltd, Glebe, Australia

[21] Appl. No.: 09/171,131

[22] PCT Filed: Apr. 10, 1997

[86] PCT No.: PCT/AU97/00226

§ 371 Date: Oct. 13, 1998

§ 102(e) Date: Oct. 13, 1998

[87] PCT Pub. No.: WO97/38064

PCT Pub. Date: Oct. 16, 1997

[30] Foreign Application Priority Data

| | | | |
|---|---|---|---|
| Apr. 10, 1996 | [AU] | Australia | PN9190 |
| May 1, 1996 | [AU] | Australia | PN9614 |
| Sep. 30, 1996 | [AU] | Australia | PO2685 |

[51] Int. Cl.[7] ..... C10L 5/00

[52] U.S. Cl. ..... 44/607; 44/620; 44/628

[58] Field of Search ..... 44/620, 628, 607

[56] References Cited

U.S. PATENT DOCUMENTS

| | | | |
|---|---|---|---|
| 4,082,515 | 4/1978 | Capes et al. | 23/313 |
| 4,144,033 | 3/1979 | Nakako et al. | 44/607 |
| 4,156,593 | 5/1979 | Farpley, Jr. | 44/620 |
| 4,830,637 | 5/1989 | Wassen | 44/620 |
| 5,256,169 | 10/1993 | Roe | 44/620 |
| 5,676,710 | 10/1997 | Chedgy | 44/620 |
| 5,897,674 | 4/1999 | Jang et al. | 44/620 |

FOREIGN PATENT DOCUMENTS

| | | |
|---|---|---|
| 28910/77 | 3/1979 | Australia . |
| WO97/25124 | 7/1997 | WIPO . |

OTHER PUBLICATIONS

Patent Abstracts of Japan, p. 130, JP A 54–134703 (Shin Nippon Seitetsu K.K.), Nov. 4, 1978.

Patent Abstracts of Japan, p. 106, JP A 05–163494 (Nippon Steel Corp.), Dec. 13, 1991.

*Primary Examiner*—Jacqueline V. Howard

*Attorney, Agent, or Firm*—Jacobson, Price, Holman & Stern, PLLC

[57] ABSTRACT

A process for the recovery of coal particles from coal tailings is described. The process comprises the steps of initially treating the coal tailings to separate therefrom a proportion of the coal particles having sizes in a specified range, and then subjecting the coal particles to a heat treatment process. In one embodiment, the separated coal particles can undergo an agglomeration in oil prior to the heat treatment. The process provides a further means of recovering coal particles of certain sizes from slurries.

18 Claims, 4 Drawing Sheets

PROCESS FOR TREATING COAL TAILINGS

This application is a 371 of PCT/AU97/00226, Apr. 10, 1997.

FIELD OF THE INVENTION

The present invention relates generally to the recovery of clean coal from coal tailings and in particular to the production of useful coal product from coal fines.

BACKGROUND ART

Solid carbonaceous materials, such as coal, have long been employed as a fuel source whether it be by simple combustion or conversion into a gaseous or liquid fuel. Certain coals when suitably processed into coke also provide an essential raw material in iron making.

All coals contain mineral particulates to some degree. Excessive levels of such mineral particulates are undesirable as they interfere with the combustion of the coal and the formation of coke. The particulates also lead to undesirable increases in ash levels during processing and combustion. Prior to utilisation, most coals have traditionally undergone a washing treatment. During such a treatment, finely divided coal or coal fines of varying sizes are washed into the waste water together with the mineral particulates and other gangue materials. These coal tailings are typically held in settling ponds on the mine site. In addition to representing a loss of coal, the disposal of the waste water can represent an environmental hazard.

It would be desirable to provide a new means of processing coal slurries that provided desirable beneficiation of coal fines and the production of a coal product that could be readily handled and, if desired, further processed as required. It would also be desirable but not essential that the new process in providing this improved beneficiation had a cost of production similar to or not significantly higher than presently used processes.

SUMMARY OF THE INVENTION

According to a first aspect, the present invention consists in a process for the treatment of coal tailings containing coal particles, comprising the steps of:

(i) forming a slurry containing the coal particles;

(ii) treating the slurry to separate therefrom a proportion of the coal particles; and (iii) subjecting the separated coal particles to a heat treatment process to recover a semi-coke or coke product.

In one embodiment of the first aspect of the process, following step (ii) the separated coal particles can undergo an agglomeration step, with the agglomerated coal particles then undergoing the heat treatment process in step (iii).

According to a second aspect, the present invention consists in a process for the treatment of coal tailings containing coal particles, comprising the steps of:

(i) forming a slurry containing the coal particles;

(ii) subjecting the slurry to a first treatment step adapted to recover coal particles having sizes between about 75 microns and about 2 mm;

(iii) subjecting the slurry to a second treatment step adapted to recover a proportion of coal particles having sizes less than about 75 microns;

(iv) mixing the coal particles recovered by the treatment process in step (ii) with the coal particles recovered by the treatment process in step (iii); and (v) subjecting the mixture of coal particles to heat treatment process to recover a semi-coke or coke product.

In one embodiment of the second aspect of the process, the coal particles recovered by the treatment process in step (iii) can undergo an agglomeration step, with these agglomerated coal particles then being mixed with the coal particles recovered by step (ii), and then subjecting the mixture to the heat treatment process in step (v).

The step of agglomerating the coal particles removed from the coal tailings in the above aspects of the invention comprises mixing with the slurry or coal particles in a suitable vessel a suitable oil and removing the agglomerates so produced. This process step relies on the fact that certain coals are hydrophobic or can be rendered hydrophobic so that when coal particles are mixed with the oil, the coal preferably collects in the oil phase and can be recovered leaving the remaining hydrophilic constituents of the slurry in aqueous suspension.

The oil that can be used in this step can consist in a wide variety of liquid hydrocarbons including kerosene, diesel oil, fuel oil and petroleum residues through to heavy aromatic materials such as coke oven tars and bitumen together with various mixtures thereof.

The slurry may be pre-heated prior to mixing with the oil and the oil may also be hot when added to the slurry.

In the above aspects of the invention, the coal particles or agglomerates also undergo a heat treatment process. In the case of the agglomerates, these are preferably heated to a temperature at least sufficient to ensure that a majority of the oil used in the agglomeration process is liberated from the agglomerates leaving the semi-coke or coke product. The liberated oil can be recovered and recycled ready for later re-use in the agglomeration step. Following the heat treatment step, appropriate cooling and, if required, further processing, the resulting semi-coke or coke product may be used as a replacement for coal in electricity utility boilers and other applications where coal is presently utilised such as the premium market for coking coal.

The heat treatment may be undertaken in any suitable vessel adapted for the purpose including a tube, pipe, cyclone, or rotary furnace or reactor. The coal particles or agglomerates are preferably heated to a temperature of at least 200° C., and will generally be heated to a temperature between 350–1500° C. in the heat treatment vessel. Where it is desired to produce coke product, the coal particles or agglomerates will typically be heated to a temperature around 1200° C., while a lower temperature would be utilised to produce the semi-coke product.

In one embodiment, the agglomerates, the coal particles and/or various mixtures thereof can undergo a multi-stage heat treatment process. In the case of the agglomerates, this multi-stage process can include an initial heat treatment at a temperature of at least 200° C. such that the majority of the oil is liberated from the agglomerates. A similar heat treatment process can be utilised in the case of the recovered coal particles. This can then be followed by a second or further heat treatments at a higher temperature to form the semi-coke or coke product. In the case of coke product, the second or further heat treatment steps would occur at around 1200° C.

Prior to undergoing the heat treatment, the coal particles or agglomerates are preferably dried in a predryer to remove the water present after the earlier processing steps. The heat treatment vessel is preferably hermetically connected to the predryer to allow the dried coal particles or agglomerates to be moved into the vessel following drying without exposure to water vapour in the atmosphere.

Following the heat treatment step, the semi-coke or coke product is preferably cooled in a cooling device that would be typically hermetically connected to the heat treatment vessel. The cooler would preferably bring the temperature of the semi-coke or coke product below the temperature at which the product would ignite on exposure to air. Further processing of the product can also be undertaken including briquetting of the product and further heat treatments.

The step of treating the coal slurry to obtain the coal particles which will then undergo the agglomeration and/or heat treatment steps can be undertaken by any suitable means. For example, the coal particles can be firstly separated from the tailings on the basis of the size, specific gravity, electrical behaviour, magnetic behaviour or chemical behaviour of the coal particles in comparison to the remaining constituents of the tailings. The separation of the coal particles having the desired sizes that will undergo the agglomerating and/or heat treatment steps from the remaining coal particles can also be undertaken by any suitable means including separation on the basis of size and/or specific gravity of the particles. In one embodiment of both aspects, the treatment step can remove substantially all coal particles having a size greater than around 75 microns from the slurry such that only those particles having a size less than or equal to around 75 microns or mixtures formed using such particles are subject to the agglomerating and/or heat treatment steps. Those particles having sizes greater than around 75 microns can be recovered and then processed into coal products using known techniques.

The treatment step preferably includes a process step in which the pulp density of a slurry containing the particles which will undergo the agglomerating and/or heat treatment steps is increased in a thickener to a level suitable for disposal in a tailings dam, but also more suitable for processing in the agglomerating and/or heat treatment steps. The thickener preferably comprises a settling vessel with a means of adding flocculant and a means of densifying and collecting the settled solids.

In one embodiment, the treatment step can comprise or include a specific gravity separation step. This step is preferably adapted to recover coal particles having dimensions between around 1.7 mm to 75 microns. This step may be performed by one or more spiral separators or classifiers. The spiral separators may be replaced by teeter bed separators or similar suitable gravity separation devices. In a spiral separator, a number of helical sluices are mounted about a single vertical column below a slurry feed box. The slurry in its descent on each sluice tends to stratify with the denser fraction of the minerals moving towards the axis of the separator and the less dense materials being carried to the outer part of the sluice. The separated fractions are recovered in separate outlets at the lower end of the separator.

In one embodiment, the treatment step includes at least one sieve screen deck over which is passed the slurry of coal particles. The sieve screen deck can be rapped or vibrated as needs dictate. The slot aperture of the deck will be set to a size as required by the application and could vary between individual sieve screen decks in the treatment process. In another embodiment, the treatment step can include a screening drum mounted substantially vertically as described in International Patent Application No. PCT/AU97/00003, the contents of which are incorporated herein by reference.

Another means of treating the coal tailings could comprise or include a cyclone separation zone comprising, preferably, at least two cyclone stages in series. The cyclone separation zone would preferably be used as a treatment step of the coal slurry prior to it entering a froth flotation process described herein.

In another embodiment, the treatment step could comprise or include a froth flotation process where a coal slurry is aerated in an aeration vessel to produce a froth product which may overflow the aeration vessel and be recovered or may be separated by conventional means such as froth scrapers or paddles. The froth flotation step, when combined with a cyclone separation zone having two cyclone separation zones in series as described above, would preferably substantially remove from the slurry coal particles having dimensions in the range of around 150–200 microns to 75–100 microns.

In a further embodiment, two or more aeration vessels may be utilised in series to ensure good recovery of the coal particles from the slurry.

In yet a further aspect, the present invention comprises a semi-coke or coke product produced using the processes defined herein.

BRIEF DESCRIPTION OF THE DRAWINGS

By way of example only, preferred embodiments of the invention are now described with reference to the accompanying drawings, in which.

PREFERRED MODE OF CARRYING OUT THE INVENTION

Figure 1:
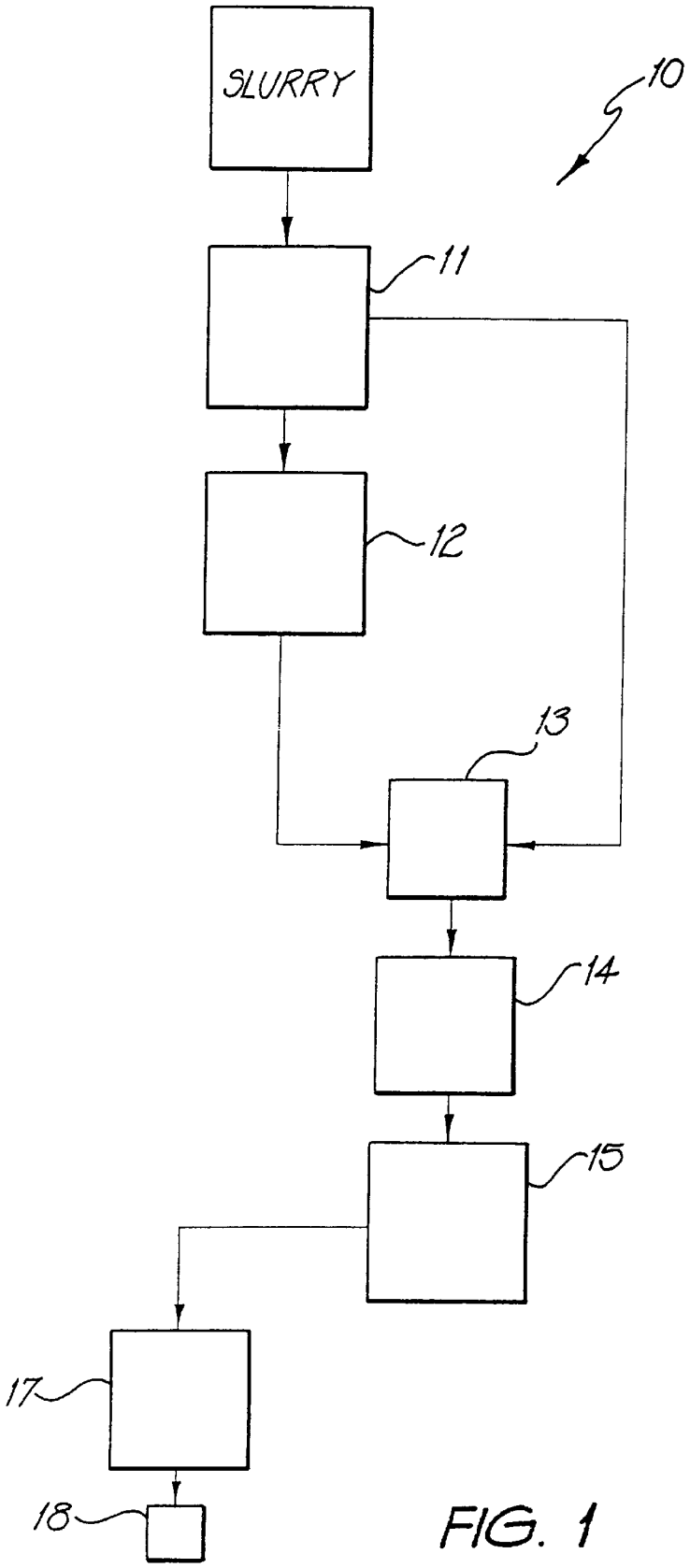
FIG. 1 is a flow chart of one embodiment of the process according to the present invention.

A flow chart of one embodiment of the process according to the present invention is generally depicted as 10 in FIG. 1.

In this embodiment, a coal slurry, which may have been dredged from a coal tailings pond, is fed through an initial treatment step 11 to remove coal particles of sizes greater than about 75 microns from the slurry. One possible embodiment of the process that may be performed at step 11 is depicted in FIG. 4.

Figure 4:
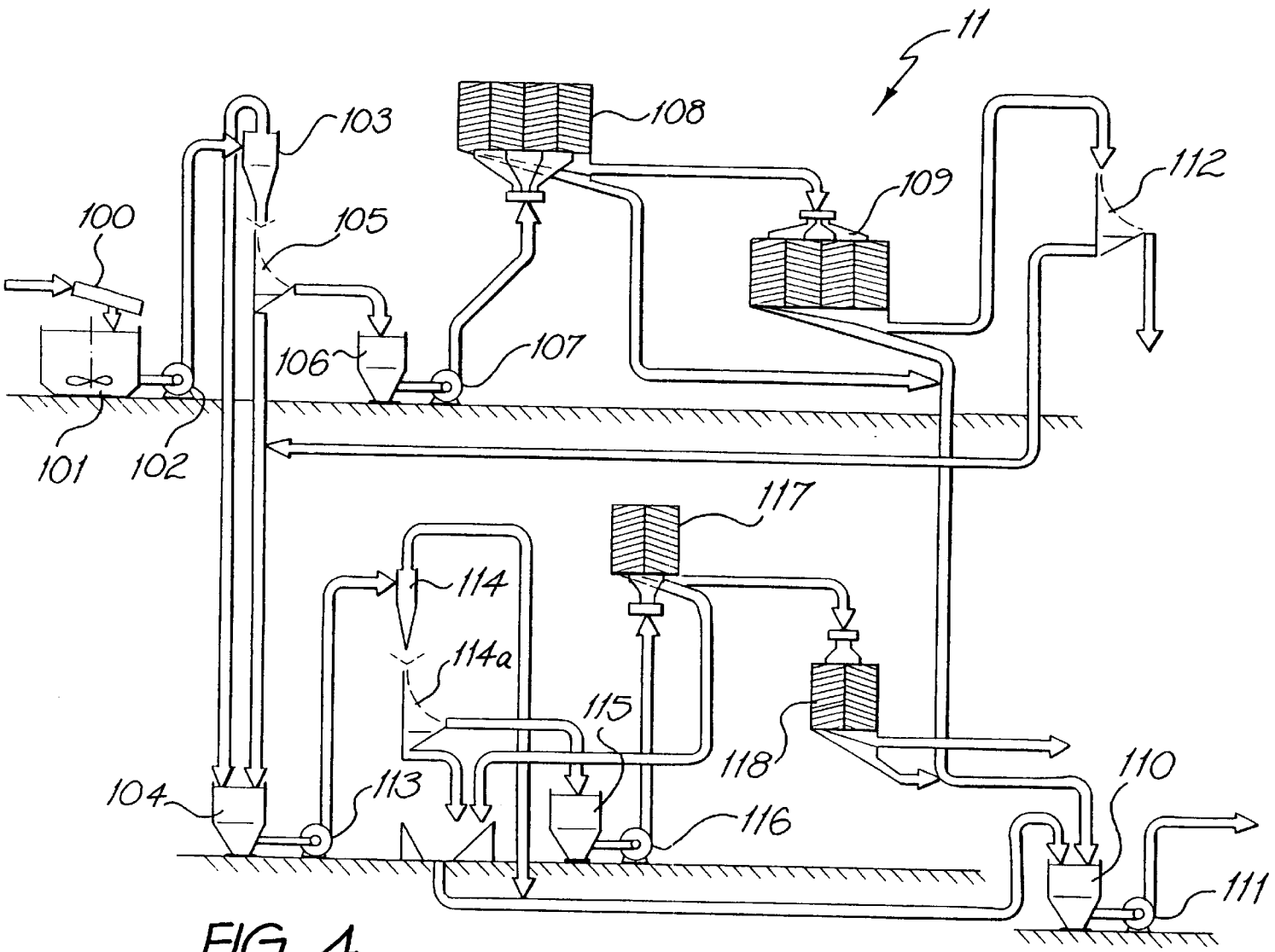
FIG. 4 is a flow diagram of one preferred embodiment of the tailings treatment step in the processes depicted in FIGS. 1–3.

Referring to FIG. 4, the coal slurry in treatment step 11 is firstly fed over a screen 100 to remove all particles greater than 1.7 mm that are recovered and processed as required. The water and particles of less than 1.7 mm are fed into a sump 101 where the slurry pulp density is adjusted to between 10–30% by weight solids, preferably 24%, and pumped by pump 102 into a hydrocyclone 103 that has an included cone angle of 15°. Oversized particles and smaller dense particles form the underflow having a pulp density of from 40–60% while the generally smaller particles and larger less dense particles form the overflow which is fed to a sump 104 forming part of a secondary treatment circuit. The underflow from the hydrocyclone 103 is repulped to a density of 20–50%, preferably 25%, and fed over a rapped or vibrated sieve screen deck 105 that has a radius of about 1.9 meters, an arc angle of about 35° and a slot aperture of about 380 microns. The water and fines tend to flow through the screen 105 to produce an underflow that flows into sump 104. The particles having a size above about 250 microns will form an overflow from the sieve screen 105 having a pulp density of about 40–60%.

While the underflow from the hydrocyclone 103 is generally of larger particles, it is contaminated with a proportion of smaller and denser particles that would normally end up in the final coal product stream and raise its gangue content. By following the hydrocyclone 103 with a sieve screen deck 105 the proportion of smaller particles can be reduced as the sieve screen deck 105 classifies solely on size with no allowance for density difference. The overflow stream from the sieve screen deck 105 thus comprises coal particles and gangue having a particle size from approximately 250 microns to 1.7 mm.

The overflow stream from the sieve screen deck 105 is repulped in sump 106 to a pulp density of 20% and pumped by pump 107 to a bank of spiral separators 108 where the particles are separated by density into a product stream and a reject stream. The product stream is fed to a further bank of spiral separators 109 to clean the product stream and to produce a final product stream and a reject stream. The reject streams from spiral separators 108 and 109 are combined and then conveyed by sump 110 and pump 111 to the next treatment step in the process. The final product stream from spiral separators 109 is dewatered on a sieve screen deck 12 similar to sieve screen deck 105 and the overflow is fed either directly or indirectly to product storage for later processing either by the treatment processes described herein or by other techniques not described herein. The underflows from sieve screen deck 112 are directed to sump 104 where they join the underflows from the hydrocyclone 103 an the sieve screen deck 105.

The sump 104 feeds a fine particle separation circuit through pump 113. The pump 113 feeds a slurry of pulp density of about 25% to a hydrocyclone 114 of a smaller included cone angle than hydrocyclone 103. The overflow from hydrocyclone 114 is fed to sump 110 while the underflow having a pulp density of about 50% is repulped to 20% and fed over sieve screen deck 114*a* similar to sieve screen deck 105 except that the gap width is about 100 microns. The underflow from sieve screen deck 114*a* is fed to sump 110 while the overflow containing particles of greater than about 75 microns is fed to a sump 115 where it is repulped and fed by pump 116 to a bank of spiral separators 117. The product stream from spiral separators 117 is fed to cleaning spiral separator 118. The reject stream from each of these separators is fed to sump 110 while the final product stream from spiral separator 118, which has a majority of coal particles having sizes between 75 microns and 250 microns, is fed to a dewatering sieve screen deck similar to deck 114 where the coal particles of greater than about 75 microns are recovered and further processed as required. If desired, a hydrocyclone similar to the hydrocyclones 103 and 114 may precede each of the dewatering sieve screen decks.

In the process depicted in FIG. 1, the slurry from sump 110 which predominantly should contain particles less than 75 microns in size is then fed through a feed pipe into a second treatment step 12. The treatment step 12 comprises a froth flotation vessel in which air and coal particles are fed into the vessel. The coal particles preferentially attach to the air bubbles that rise upwardly in the flotation agent in the vessel, normally an aqueous solution, to form a froth product that is scraped from the top of the vessel using a scraper blade. The coal particles are then washed and filtered from the froth product ready for further processing. The gangue particles introduced into the vessel settle downwardly in the vessel and can be recovered from the bottom of the vessel as desired.

The slurry of coal particles recovered from the treatment step 12 are then mixed in a mixer, generally depicted as 13, with the coal particles recovered from the final product stream of spiral separator 118 in treatment step 11.

The mixture of particles is then fed into a predryer unit 14 which sufficiently heats the mixture to vaporise the water. Hermetically connected to the predryer unit 14 is a heat treatment vessel 15 into which the coal particles are transferred following drying in the predryer unit 14. In the heat treatment vessel 15, the coal particles are heated to a temperature of about 1200° C. which pyrolises the coal particles leading to the liberation of volatiles from the coal and the production of a coke product. The coke product is then passed directly through a cooler unit 17 which brings the coke product below a temperature at which it would ignite if exposed to air.

The cooled coke product 18 produced by the process 10 can be further processed as required, the further processing including briquetting of the coke product and/or further heat treatment steps.

Figure 2:
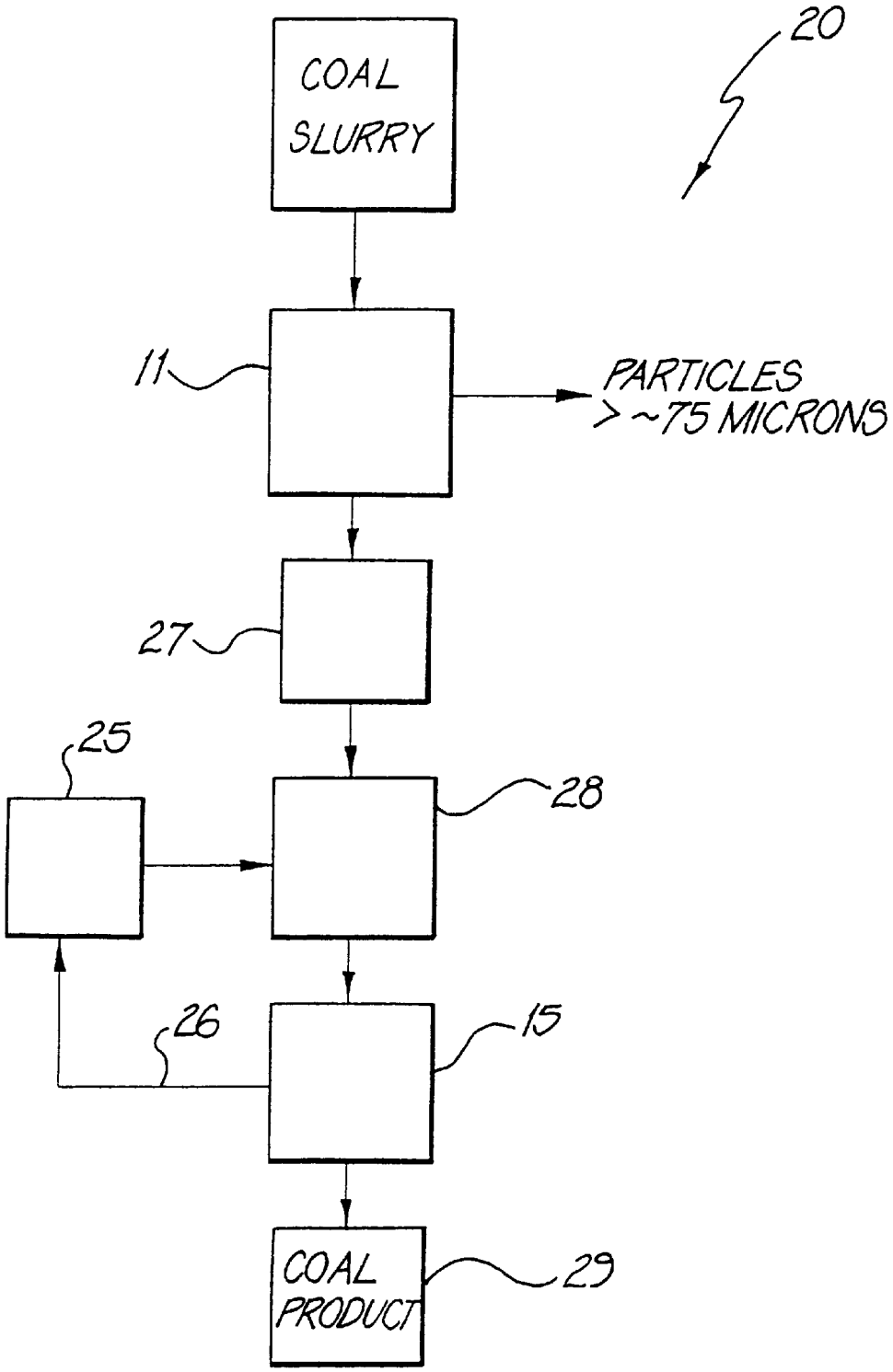
FIG. 2 is a flow chart of a second embodiment of the present invention.

A flow chart of a different embodiment of the process according to the present invention is generally depicted as 20 in FIG. 2, where like steps have the same reference numerals as those steps in FIG. 1.

In this embodiment, a coal slurry, which may of been dredged from coal tailings pond, is also fed through the initial treatment step 11 to remove coal particles of sizes greater than around 75 microns which do not undergo further treatment in this process. Again, one possible embodiment of the processes that may be performed at step 11 is depicted in FIG. 4.

In the embodiment of the process depicted in FIG. 2, the slurry from sump 110 which predominantly should contain particles less than 75 microns in size is then fed via a feed pipe into a thickener vessel 27. The thickener vessel 27 comprises a settling vessel into which flocculant chemicals may be added. The addition of flocculant leads to rapid settling of the coal particles which are collected at the bottom of the vessel such that the slurry is at an appropriate pulp density for processing in the agglomeration reactor 28. The slurry drawn from the thickener vessel 27 is then fed to the agglomeration reactor 28. Oil flows from a tank 25 into the reactor 28 and the coal slurry and oil are mixed together in the reactor 28.

The coal agglomerates produced in the reactor 28 are removed from the reactor and then fed into a heat treatment vessel 15. In the vessel 15, the agglomerates undergo a heat treatment sufficient to at least partially liberate the oil in the agglomerate which is allowed to exit the vessel 15 and is collected ready for recycling back into the agglomeration reactor 28 as represented by line 26.

The coal product 29 which remains after this heat treatment is removed from vessel 15, cooled as required and can be further processed as needs dictate.

Figure 3:
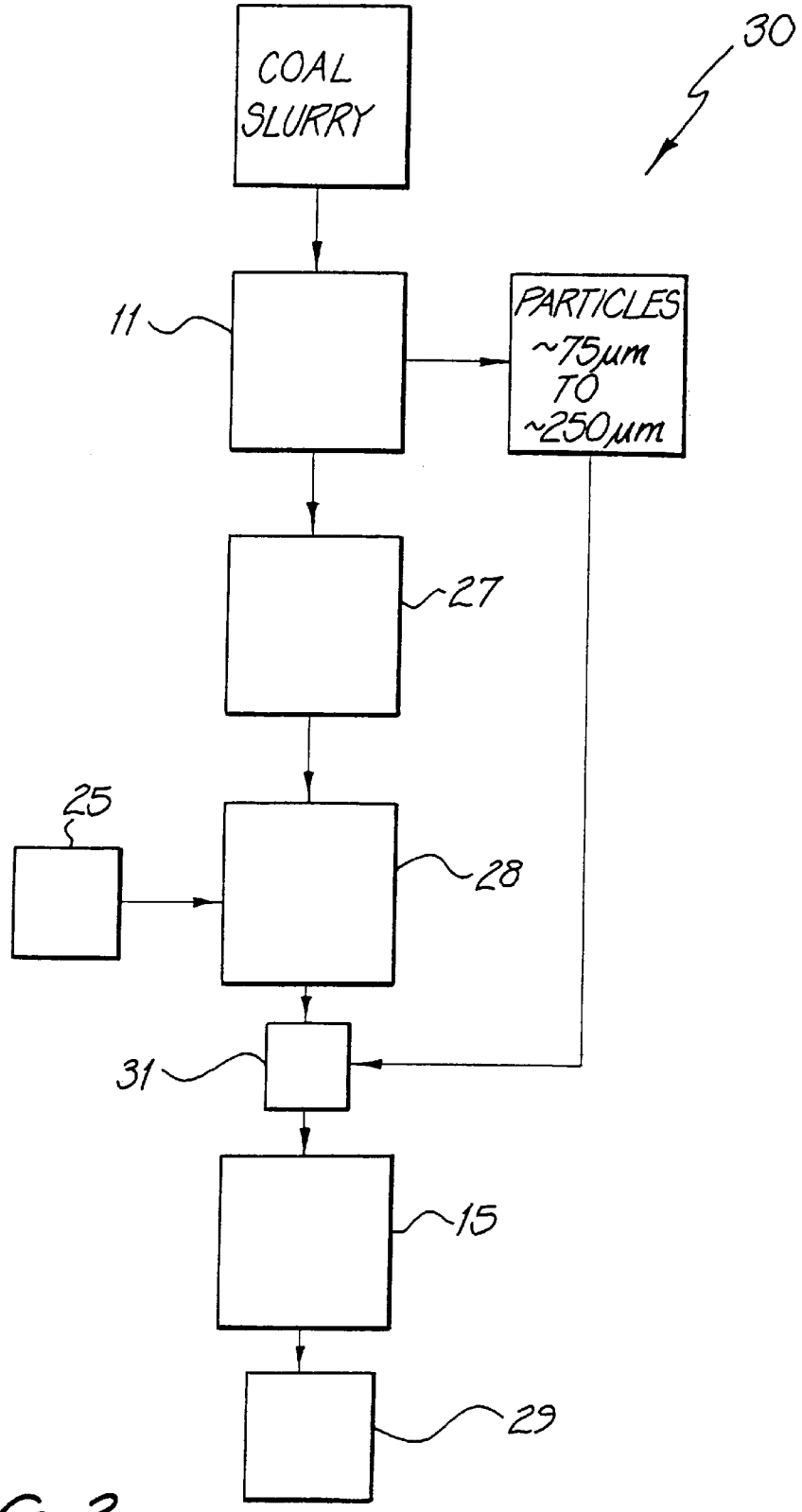
FIG. 3 is a flow chart of a third embodiment of the present invention.

A flow chart of another embodiment of the invention is generally depicted as 30 in FIG. 3. In this embodiment, the same reference numerals are used to describe the same steps or processes as earlier described with reference to FIGS. 1 and 2.

In process 30, the agglomerated coal particles produced in reactor 28 are combined with at least some of the coal particles having sizes between 75 and 250 microns recovered from the final product stream of spiral separator 118 in treatment step 11 to form a mixture 31.

The mixture 31 is then fed into the heat treatment vessel 15 where it undergoes a heat treatment of between 200–1500° C. to form a coal product 29. Where coke product is to be produced, the mixture 31 undergoes a heat treatment of around 1200° C.

In another embodiment of the process 30, the coal agglomerates may firstly undergo an initial heat treatment step prior to being mixed with the 75–250 microns size particles to form the mixture 31. This initial heat treatment step would consist of a heat treatment of at least 200° C. so as to lead to a liberation of the majority of the oil from the agglomerates which would be collected ready for recycling back into the agglomeration reactor 28.

The processes depicted in the drawings provide a means of removing coal particles having a range of dimensions in an efficient manner from a slurry of coal tailings.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

We claim:

1. A process for the treatment of coal tailings containing coal particles, comprising the steps of:

(i) forming an aqueous slurry containing the coal particles;

(ii) subjecting the slurry to a first treatment step adapted to recover coal particles having sizes between 75 microns and 2 millimeters;

(iii) subjecting the slurry to a second treatment step adapted to recover a proportion of coal particles having sizes less than 75 microns;

(iv) mixing the coal particles recovered by the treatment process in step (ii) with the coal particles recovered by the treatment process in step (iii); and (v) subjecting the mixture of coal particles to a heat treatment process to recover a semi-coke or coke product.

2. A process for the treatment of coal tailings containing coal particles, comprising the steps of:

(i) forming an aqueous slurry containing the coal particles;

(ii) subjecting the slurry to a first treatment step adapted to recover coal particles having sizes between 75 microns and 2 millimeters;

(iii) subjecting the slurry to a second treatment step adapted to recover a proportion of coal particles having sizes less than 75 microns;

(iv) agglomerating the recovered coal particles having sizes less than 75 microns;

(v) mixing the agglomerated coal particles with the coal particles recovered by the treatment process in step (ii); and (vi) subjecting the mixture of agglomerates and coal particles to a heat treatment process to recover a semi-coke or coke product.

3. The process for the treatment of coal tailings containing coal particles as defined in claim 2 wherein the step of agglomerating the coal particles comprises mixing the coal particles in a liquid hydrocarbon and removing the agglomerates so produced.

4. The process for the treatment of coal tailings containing coal particles as defined in claim 3 wherein the liquid hydrocarbon used in the agglomerating step is diesel oil, fuel oil, kerosene, coke oven tar, bitumen, or various mixtures thereof.

5. The process for the treatment of coal tailings containing coal particles as defined in claim 3 wherein in the heat treatment step the agglomerates are heated to a temperature at least sufficient to ensure that a majority of the liquid hydrocarbon used in the agglomerating process is liberated from the agglomerates leaving the semi-coke or coke product.

6. The process for the treatment of coal tailings containing coal particles as defined in claim 5 wherein the liberated liquid hydrocarbon is recovered and recycled ready for later re-use in the agglomerating step.

7. The process for the treatment of coal tailings containing coal particles as defined in claim 2 wherein the heat treatment is undertaken in a tube, pipe, cyclone, or rotary furnace or reactor.

8. The process for the treatment of coal tailings containing coal particles as defined in claim 7 wherein the heat treatment step the coal particles are heated to a temperature between 200° C. and 1500° C.

9. The process for the treatment of coal tailings containing coal particles as defined in claim 8 wherein the coal particles are heated to a temperature around 1200° C.

10. The process for the treatment of coal tailings containing coal particles as defined in claim 2 wherein the coal particles undergo a multi-stage heat treatment process.

11. The process for the treatment of coal tailings containing coal particles as defined in 10 wherein where agglomerates have been formed, the multi-stage process includes an initial heat treatment at a temperature of at least 200° C. followed by a second or further heat treatments at about 1200° C.

12. The process for the treatment of coal tailings containing coal particles as defined in claim 2 wherein the coal particles prior to undergoing the heat treatment process are dried in a predryer to remove any water present after the earlier processing steps.

13. The process for the treatment of coal tailings containing coal particles as defined in claim 2 wherein the semi-coke or coke product produced by the heat treatment is cooled in a cooling device hermetically connected to the heat treatment vessel.

14. The process for the treatment of coal tailings containing coal particles as defined in claim 2 wherein the coal particles are firstly separated from the tailings on the basis of the size, specific gravity, electrical behaviour, magnetic behaviour and/or chemical behaviour of the coal particles in comparison to the remainder of the tailings.

15. The process for the treatment of coal tailings containing coal particles as defined in claim 2 wherein coal particles within a specific range of sizes are separated from the remaining coal particles on the basis of the particular size and specific gravity.

16. The process for the treatment of coal tailings containing coal particles as defined in claim 15 wherein the separation of the coal particles is performed using one or more spiral separators, teeter bed separators, and/or sieve screen decks.

17. The process for the treatment of coal tailings containing coal particles as defined in claim 14 wherein the process of separating the coal particles from the tailings includes a froth flotation process wherein the slurry of coal particles is aerated in an aeration vessel to produce a froth product which may overflow the aeration vessel and be recovered by froth scrapers or paddles.

18. Semi-coke or coke product produced using the process as defined in claim 2.

* * * * *